US009050239B1

(12) United States Patent
Lin

(10) Patent No.: US 9,050,239 B1
(45) Date of Patent: Jun. 9, 2015

(54) CRUTCH

(71) Applicant: Green Young Industrial Co., Ltd., Tainan (TW)

(72) Inventor: Fang-Sheng Lin, Tainan (TW)

(73) Assignee: Green Young Industrial Co., Ltd., Tainan (TW)

( * ) Notice: Subject to any disclaimer, the term of this patent is extended or adjusted under 35 U.S.C. 154(b) by 0 days.

(21) Appl. No.: 14/475,601

(22) Filed: Sep. 3, 2014

(30) Foreign Application Priority Data

Apr. 1, 2014 (TW) ..... 103205608 U
Apr. 1, 2014 (TW) ..... 103205609 U

(51) Int. Cl.
*A61H 3/02* (2006.01)

(52) U.S. Cl.
CPC ..... *A61H 3/02* (2013.01)

(58) Field of Classification Search
CPC ..... A61H 3/00; A61H 3/02; A45B 9/02; Y10T 403/0783
USPC ..... 135/65, 68, 72, 76; 601/35; 403/17–18, 403/378, 379.2
See application file for complete search history.

(56) References Cited

U.S. PATENT DOCUMENTS 885,339 A * 4/1908 Hargrove ..... 135/69
1,501,580 A * 7/1924 Beam ..... 135/69
2,172,047 A * 9/1939 Jacobucci ..... 135/69
2,669,244 A * 2/1954 Greene et al. ..... 135/72
4,753,259 A * 6/1988 Hansen et al. ..... 135/68
4,979,533 A * 12/1990 Hansen et al. ..... 135/69
5,291,910 A * 3/1994 Bui et al. ..... 135/68
5,299,589 A * 4/1994 Zatulovsky ..... 135/68
5,381,813 A * 1/1995 Miric et al. ..... 135/72
6,079,431 A * 6/2000 Su ..... 135/72
6,314,977 B1 * 11/2001 Obitts et al. ..... 135/68
7,069,940 B2 * 7/2006 Tsai ..... 135/72
8,069,869 B1 * 12/2011 Huang ..... 135/72

FOREIGN PATENT DOCUMENTS

JP 07328083 A * 12/1995 ..... A61H 3/02
JP 09313554 A * 12/1997 ..... A61H 3/02
JP 2000237253 A * 9/2000 ..... A61H 3/02

* cited by examiner

*Primary Examiner* — Winnie Yip
(74) *Attorney, Agent, or Firm* — Alan D. Kamrath; Kamrath IP Lawfirm, P.A.

(57) ABSTRACT

A crutch includes a main frame mainly constructed of two spaced posts, wherein each post defines multiple positioning holes. A handgrip includes a main piece and two fasteners. The main piece defines two receiving spaces at its two ends for receiving the posts of the main frame. Each fastener has a positioning stud, a first portion, and a second portion. The first and second portions enclose one post of the main frame and can be operated to move between a first position and a second position. When each fastener is moved to the first position, the positioning stud is inserted into one of the positioning holes, while the first portion is engaged with the main piece. When the fastener is moved to the second position, the positioning stud is clear of the positioning hole, while the fastener is unable to leave the post.

11 Claims, 11 Drawing Sheets

CRUTCH

BACKGROUND OF THE INVENTION

The present invention relates to a crutch and, more particularly, to a crutch with a handgrip.

FIGS. 1 through 3 show a prior-art crutch 1, which includes a main frame 11 and a handgrip 12. The main frame 11 is composed of two spaced posts. The handgrip 12 is mounted to the posts of the main frame 11 such that the handgrip 12 can be adjusted along the posts to adjust the height of the handgrip 12.

Each post of the main frame 11 defines a plurality of positioning holes 111 for allowing the handgrip 12 to adjust its height. The handgrip 12 includes a main piece 121 and two fasteners 122. The main piece 121 has two end rings at two opposite ends thereof for respectively receiving therein one post of the main frame 11. Each fastener 122 is provided with two engaging tabs 1222 at its two sides and a positioning stud 1221 between the engaging tabs 1222. When the fastener 122 is located at a first position (as shown by the left fastener 122 in FIG. 3), the positioning stud 1221 thereof can be inserted into one of the positioning holes 111, while the engaging tabs 1222 thereof can be fastened to one end ring of the main piece 121 by engaging with two stop ribs 1211 of the end ring, so that the handgrip 12 can be mounted at the height where the positioning hole 111 is located. When the fastener 122 is located at a second position (as shown by the right fastener shown in FIG. 3), the positioning stud 1221 thereof can be clear of the positioning hole 111; the engaging tabs 1222 are moved back from the end ring of the main piece 121 but hooks 1223 at the free ends of the engaging tabs 1222 are blocked by the stop ribs 1211 of the end ring of the main piece 121. Under this condition, the handgrip 12 can be moved upwardly or downwardly to another location of the posts of the main frame 11 so as to adjust its height:

However, when a user applies an excessive force to pull the fastener 122, the hook 1223 thereof may slip off the stop rib 1211 of the end ring of the main piece 121, and thus the fastener 122 can be taken away from the main piece 121, thus causing troubles to the user. Besides, since the engaging tabs 1222 of the fastener 122 are designed to move along the extending direction of the positioning stud 1221, when the fastener 122 is subject to a force of different direction, such a collision, the fastener 122 is easy to break.

BRIEF SUMMARY OF THE INVENTION

It is an objective of the present invention to provide a crutch that can prevent the fasteners from entirely leaving the handgrip thereof to facilitate a user in adjusting the handgrip.

The crutch of the present invention generally includes a main frame and a handgrip. The main frame includes two spaced posts, wherein each post defines a plurality of positioning holes. The handgrip includes a main piece and two fasteners. The main piece defines two receiving spaces at its two opposite ends for receiving the two posts of the main frame. Each fastener has a positioning stud, a first portion, and a second portion. The positioning stud is provided at the second portion and faces towards the first portion. The first portion and the second portion are formed into a completely closed member that encloses one of the two posts of the main frame and can be operated to move between a first position and a second position. Thus, when each fastener is moved to the first position, the positioning stud thereof is inserted into one of the positioning holes of one post, while the first portion thereof is engaged with one end of the main piece; when the fastener is moved to the second position, the positioning stud thereof is clear of the positioning hole, while the fastener is unable to leave the post.

With the crutch of the present invention, no matter whether the positioning stud of each fastener is inserted into or clear of one positioning hole, due to the fastener being included of the first portion and the second portion and being formed into a completely closed member that encloses one post of the main frame, the fastener is unable to leave the post. This feature can facilitate a user to adjust the height of the handgrip. Furthermore, since the first portion and the second portion enclose the post, the first portion can resist the forces of various directions, so that the first portion is not easy to be damaged and thus the product durability can be increased.

In an embodiment, the first portion of each fastener of the handgrip is provided with an engagement protrusion while the main piece of the handgrip defines, at its one end, an engagement recess corresponding to the engagement protrusion.

In an embodiment, the first portion of each fastener of the handgrip defines an engagement recess while the main piece of the handgrip is provided at its one end with an engagement protrusion corresponding to the engagement recess.

In an embodiment, the second portion of each fastener is formed as a curved structure conforming to an associated post of the main frame, the first portion of each fastener is formed as a curved structure opposite to the second portion of the fastener, the two curved structures are formed into a completely closed member that defines a confined space therebetween for receiving the associated post of the main frame. The first portion of the fastener is configured with at least two different curvatures, the utmost of which is located halfway of the first portion, at a greatest distance from the second portion of the fastener.

In an embodiment, the first portion is partially made of elastic material.

In an embodiment, the second portion of each fastener functions as an operational grip, and the operational grip is provided with a rugged surface.

The present invention will become clearer in light of the following detailed description of illustrative embodiments of this invention described in connection with the drawings.

DETAILED DESCRIPTION OF THE INVENTION

Figure 1:
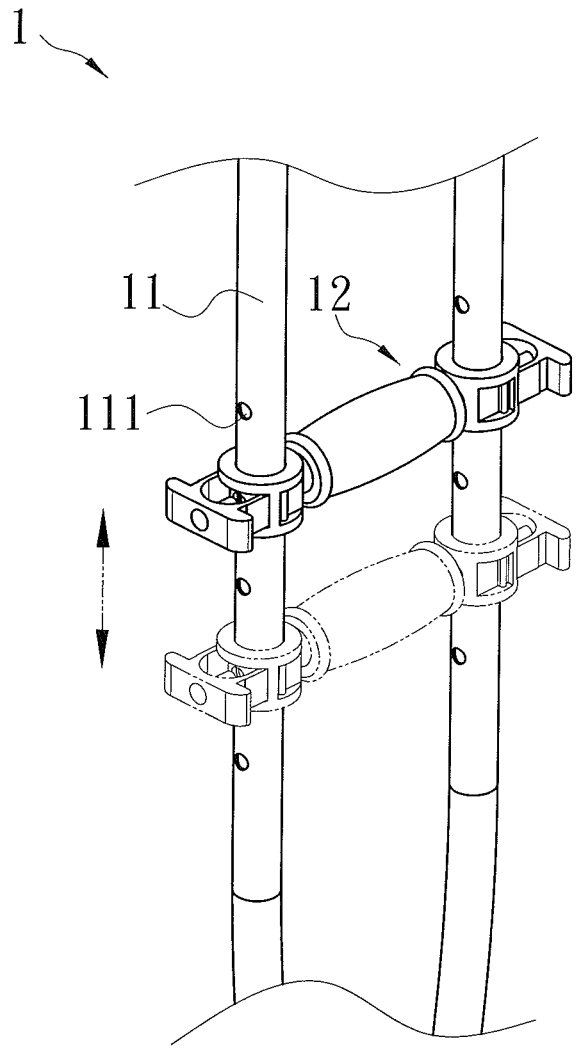
FIG.1 Prior Art
FIG. 1 shows a schematic view of a prior-art crutch, which illustrates how a handgrip thereof can be mounted to a main frame thereof at different heights.
Figure 2:
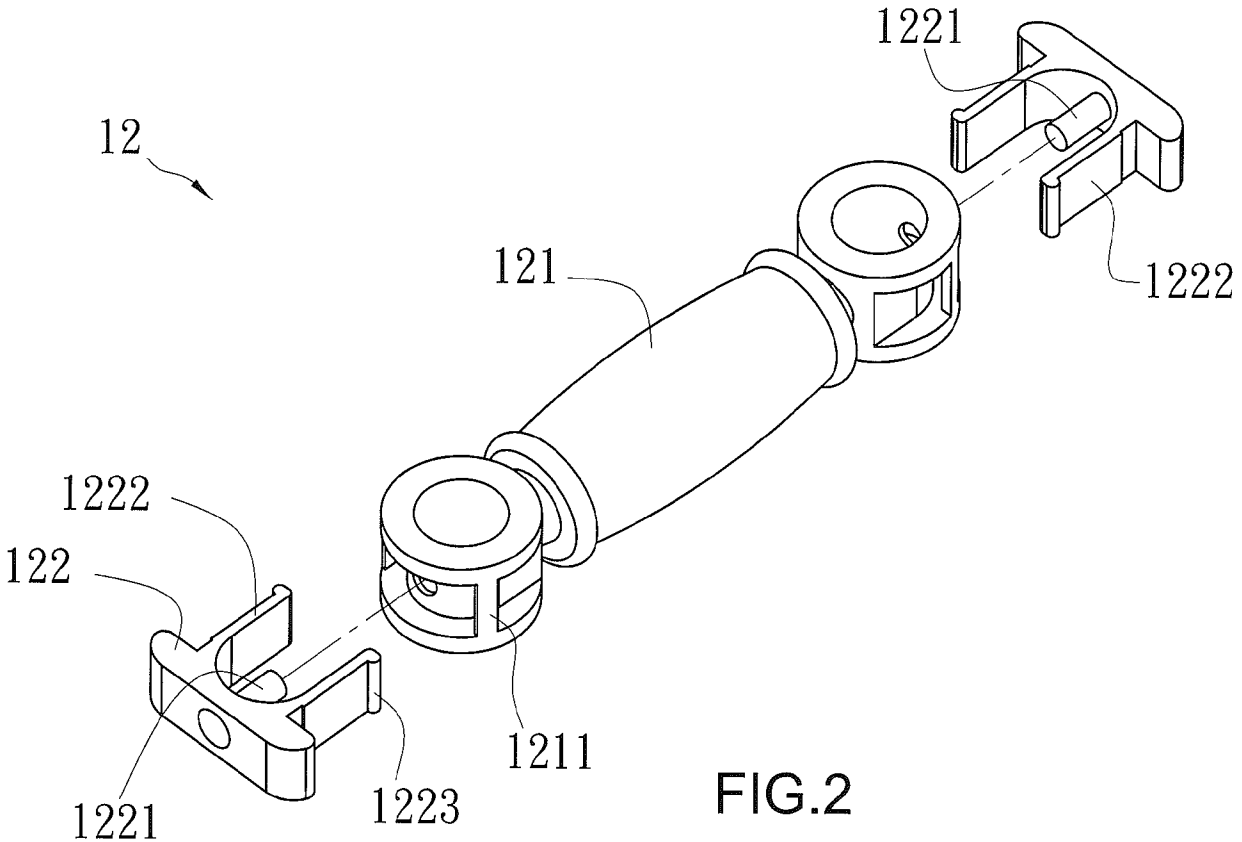
FIG.2 Prior Art
FIG. 2 shows an exploded view of the handgrip of the prior-art crutch.
Figure 3:
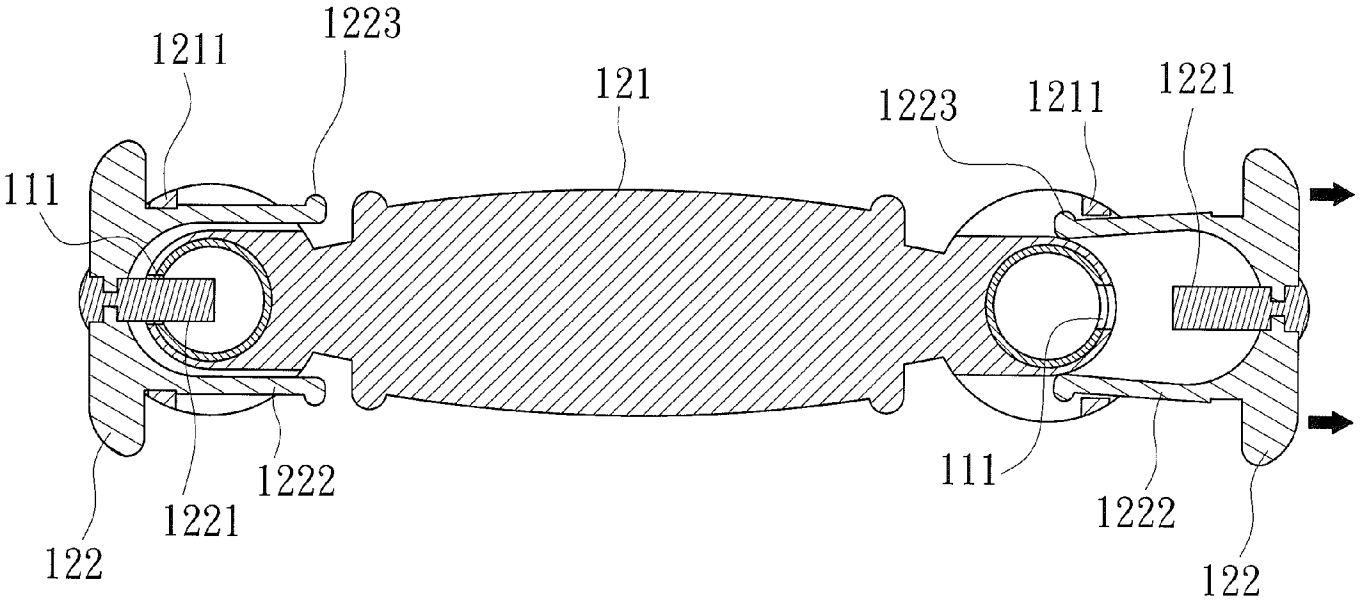
FIG.3 Prior Art
FIG. 3 shows a sectional view of the handgrip of the prior-art crutch.
Figure 4:
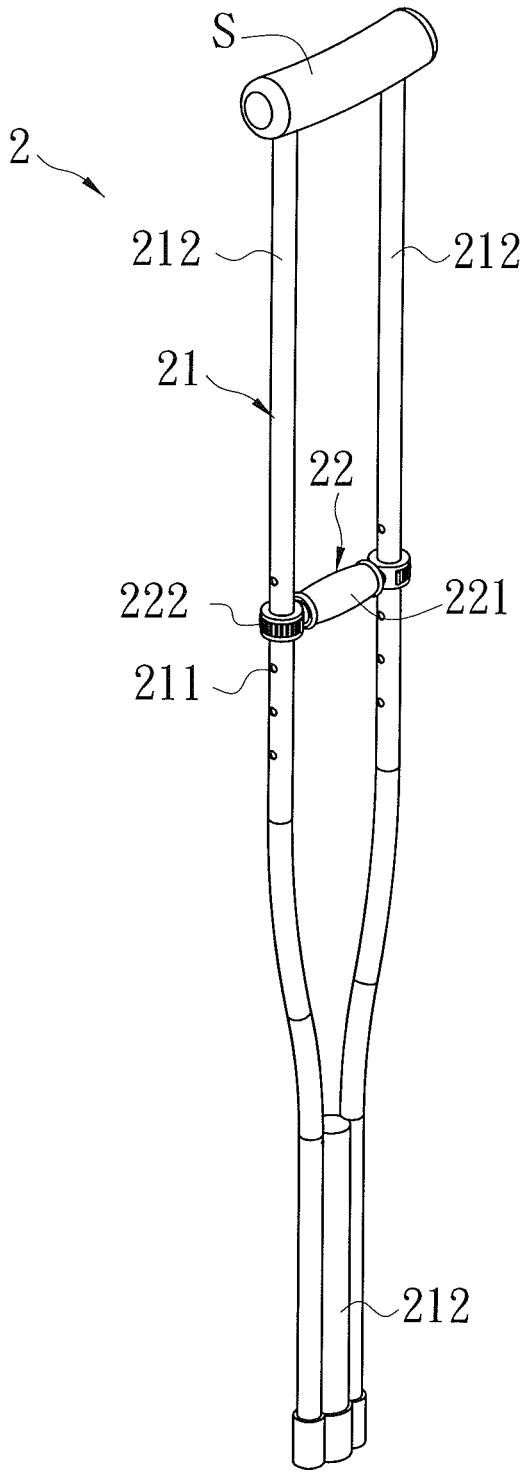
FIG. 4 shows a 3-dimensional view of a crutch according to an embodiment of the present invention.
Figure 5:
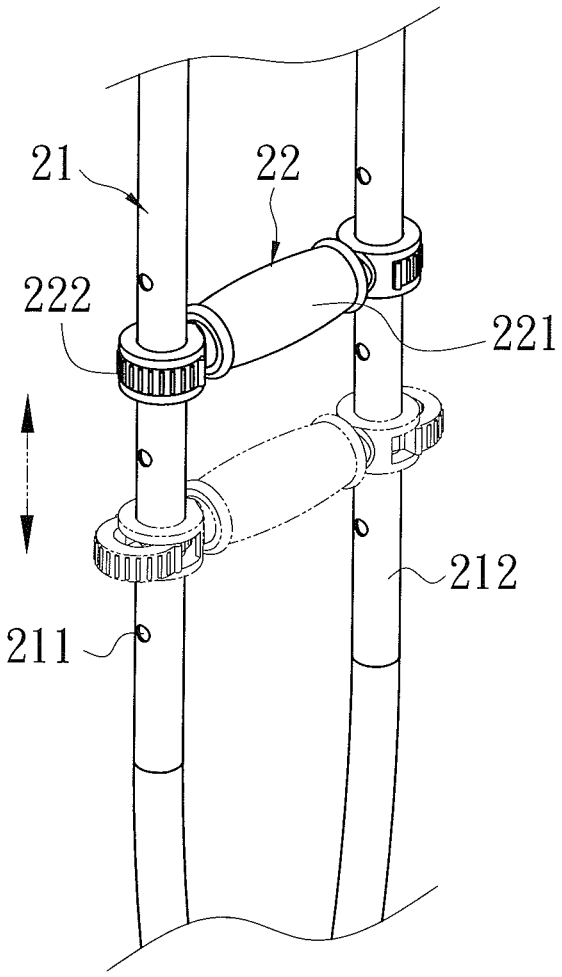
FIG. 5 shows a schematic view of the crutch of FIG. 4, which illustrates how a handgrip thereof can be mounted to a main frame thereof at different heights.
Figure 6:
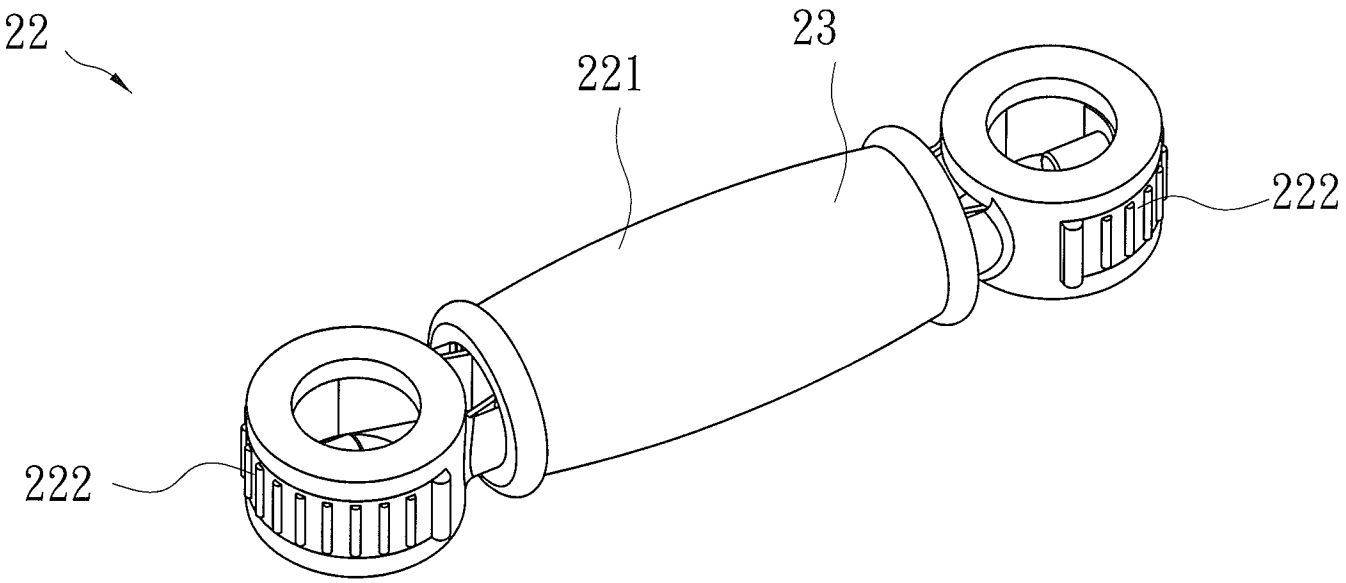
FIG. 6 shows a 3-dimensional view of the crutch of FIG. 4.
Figure 7:
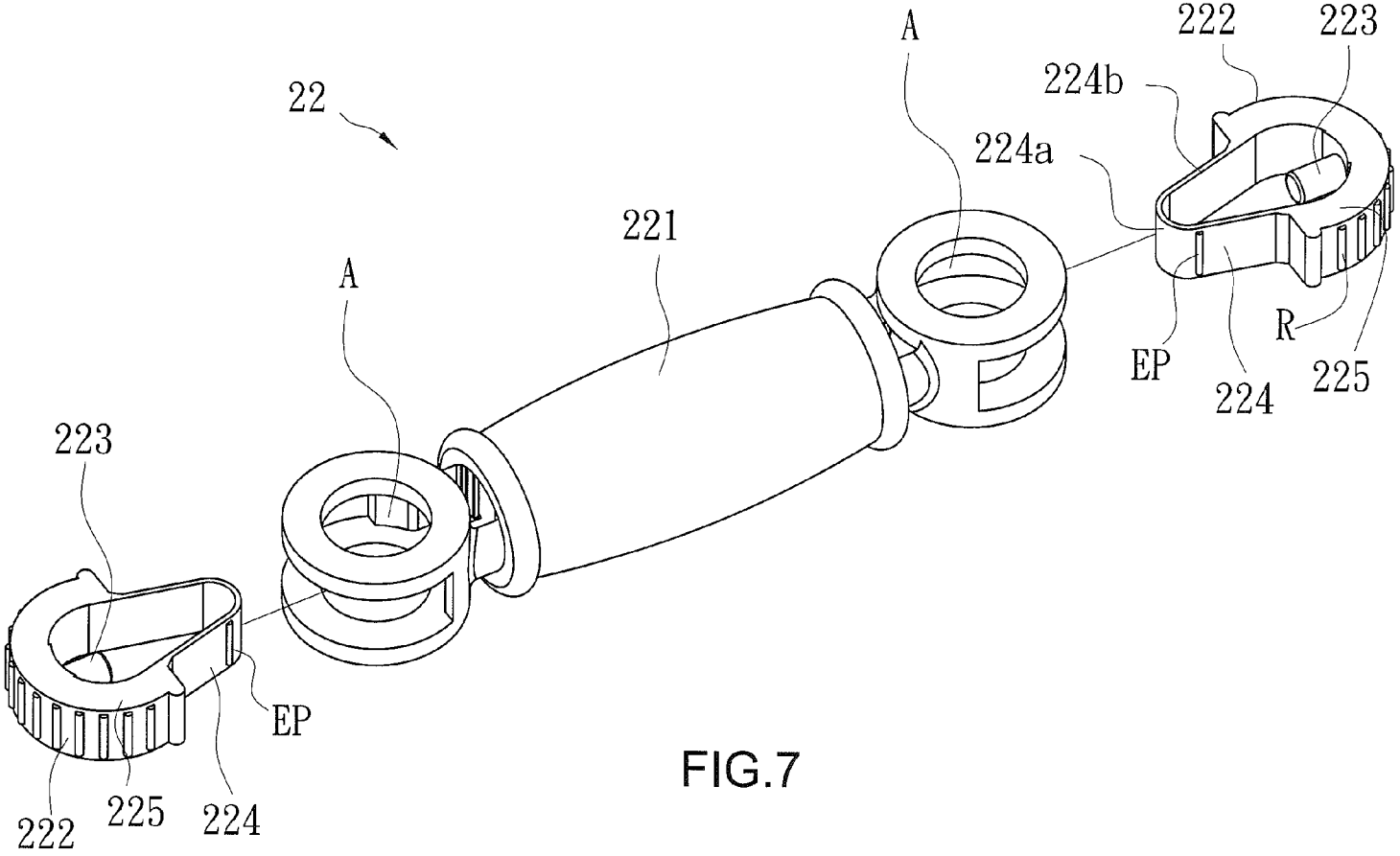
FIG. 7 shows an exploded view of the crutch of FIG. 6.

The following paragraphs will illustrate preferred embodiments of the present invention, concerning a crutch, with reference to the accompanying drawings, wherein identical elements of the embodiment will use the same reference numeral.

FIGS. 4 through 8 show a crutch 2 of a preferred embodiment of the present invention, wherein the crutch 2 generally includes a main frame 21 and a handgrip 22. The main frame 21 is constructed of multiple posts 212, wherein two spaced posts are the main posts, each of which defines a plurality of positioning holes 211. In this embodiment, three posts are used to construct the main frame 21, wherein the two spaced posts, which define the positioning holes 211, are substantially parallel at their upper portions, while one post 212 is combined with the lower portions of the two spaced posts. Also, the positioning holes 211 of one of the two spaced posts 212 are aligned with the positioning holes 211 of the other of the two spaced posts 212. It is noted that the structure of the main frame 21 shown in the figures is only one example and should not be used as a limitation for the structure of the main frame 21. Furthermore, the main frame 21 is provided with an underarm support (S) to be put under a user's underarm for supporting the user's weight.

The handgrip 22 includes a main piece 221 and two fasteners 222. The main piece 221 defines two receiving spaces (A) at two opposite ends thereof (see FIG. 7) for respectively receiving the two spaced posts 212 of the main frame 21, and thus the main piece 221 can be moved upwardly or downwardly by a user in adjusting the height of the handgrip 22.

In addition to the two receiving spaces (A) for receiving the two spaced posts 212 of the main frame 21, the main piece 221 is provided with a sleeve 23 to facilitate a user to hold the handgrip 22.

The two fasteners 222 are respectively assembled with the opposite ends of the main piece 221. Each fastener 222 has a positioning stud 223, a first portion 224, and a second portion 225. The positioning stud 223 is provided at the second portion 225 and faces towards the first portion 224. The positioning stud 223 can be inserted into one of the positioning holes 211. Thus, the height of the handgrip 22 can be adjusted by inserting the positioning stud 223 into a different positioning hole 211. Particularly, the second portion 225 is formed as a curved structure conforming to one post 212 of the main frame 21; the first portion 224 is formed as a curved structure that is formed together with the second portion 225 to become a completely closed member that encloses one post 212 of the main frame 21. Namely, each fastener 222 is formed as a completely closed member, which is placed to coincide with one receiving space (A) defined at one end of the main piece 221 so that the post 212 of the main frame 21 can be inserted through the receiving space (A) and the enclosed space of the completely closed member. Thus, the fastener 222 will not slip off the post 212 of the main frame 21 no matter what the direction of a force being applied to the fastener 222 is, and this feature can facilitate a user in adjusting the height of the handgrip 22.

Each fastener 222 can be operated to move along the extending direction of the positioning stud 223, between a first position and a second position. When the fastener 222 is moved to the first position (as shown by the left fastener 222 shown in FIG. 8), the positioning stud 223 thereof will be inserted into one of the positioning holes 211 of one post 212 while the first portion 224 thereof will be engaged with the main piece 221, so that the fastener 222 can be fastened to the post 121. When the fastener 222 is moved to the second position (as shown by the right fastener 222 shown in FIG. 8), the positioning stud 223 thereof will be clear of the positioning hole 211 and the first portion 224 thereof will be disengaged from the main piece 221 but the fastener 222 still encloses the post 212, so that the fastener 222 together with the main piece 221 can be moved to another positioning hole 211 for adjusting the height of the handgrip 22. After the fastener 222 is moved to the desired positioning hole 211, the fastener 222 can be moved to the first position again, so that the positioning stud 223 can be inserted into the desired positioning hole 211 and engaged with the main piece 211, to allow the fastener 222 and the main piece 221 to be fastened to the post 212, thereby adjusting the handgrip 222 to the desired height.

Figure 8:
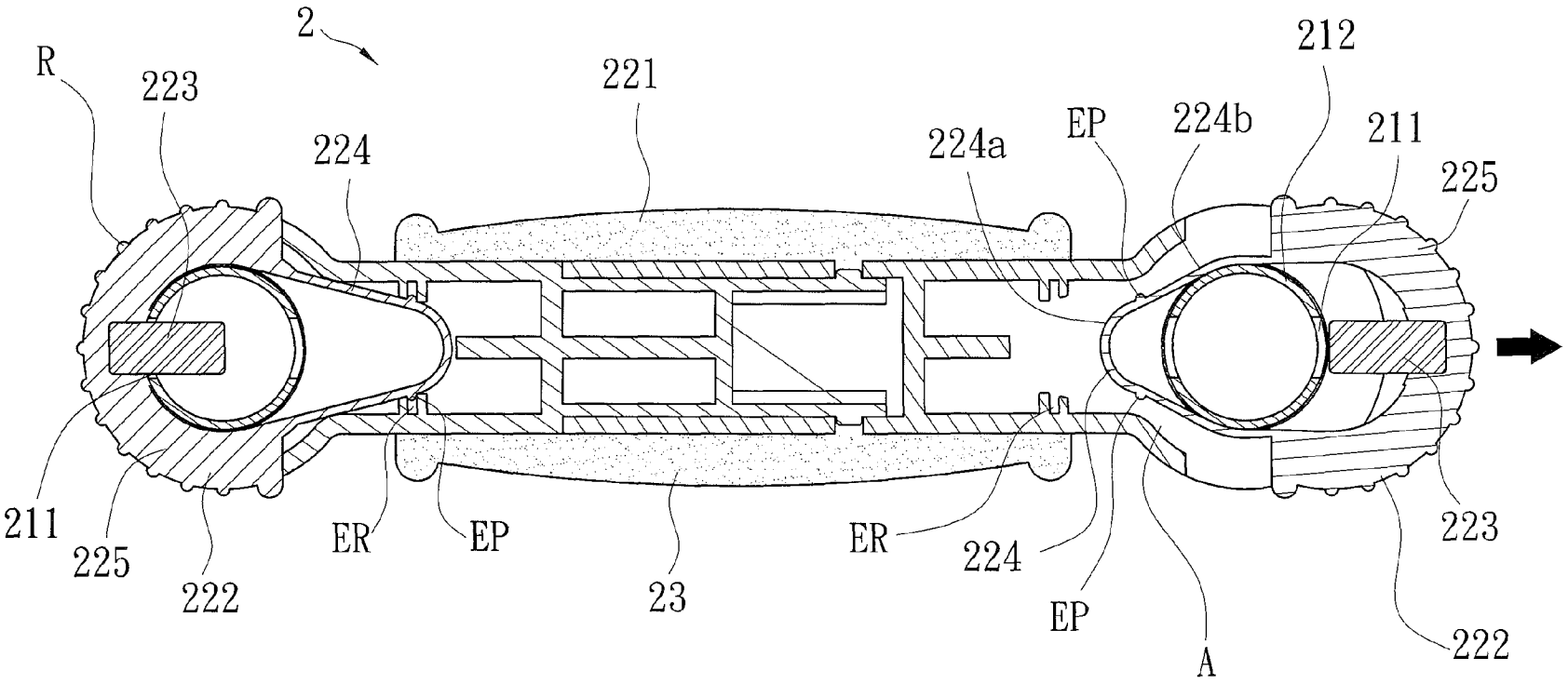
FIG. 8 shows a sectional view of the crutch of FIG. 6.

For increasing the fastening effect, as shown in FIG. 8, the first portion 224 of each fastener 222 is provided with at least one engagement protrusion (EP), while the main piece 221 defines an engagement recess (ER) corresponding to the engagement protrusion (EP). Thus, when the fastener 222 is located at the first position, the engagement protrusion (EP) can be engaged with the engagement recess (ER); when the fastener 222 is located at the second position, the engagement protrusion (EP) can be disengaged from the engagement recess (ER). Alternatively, the first portion 224 of the fastener 222 can define an engagement recess (ER), while the main piece 221 can be provided with an engagement protrusion (EP) corresponding to the engagement recess (ER).

The first portion 224 can be partially made of elastic material. For example, the engagement protrusion (EP) of the first portion 224 can be made of elastic material. Alternatively, the first portion 224 can be entirely made of elastic material. Thus, when the fastener 222 is moved outwardly to the second position, the first portion 224 thereof can be deformed outwardly by the post 212 to permit the outward movement, so that the positioning stud 223 thereof will be clear of the positioning hole 211. Moreover, the first portion 224 of the fastener 222 can be configured with at least two different curvatures. In this embodiment, the first portion 224 is configured with a first curved section 224*a* and a second curved section 224*b*. The first curved section 224*a*, which has a greatest curvature, is located halfway of the first portion, at a greatest distance from the second portion 225. With the provision of different curvatures, the performance of the first portion 224 can be increased and applications of the first portion 224 can be diversified.

Furthermore, the second portion 225 of each fastener 222 can function as an operational grip. In manufacturing the fastener 222, the positioning stud 223, the first portion 224, and the second portion 225 can be integrally formed. However, other ways of making the fastener 222 can also be applied, for example, the fastener 222 can be made by joining those parts together through engaging, bonding, or welding. Furthermore, the second portion 225, which serves as an operational grip, can be provided with a rugged surface (R) to facilitate a user to hold the fastener 222, so that the fastener 222 can be operated more conveniently. The rugged surface (R) can be implemented by providing a plurality of ribs on the surface of the second portion 225.

Figure 9:
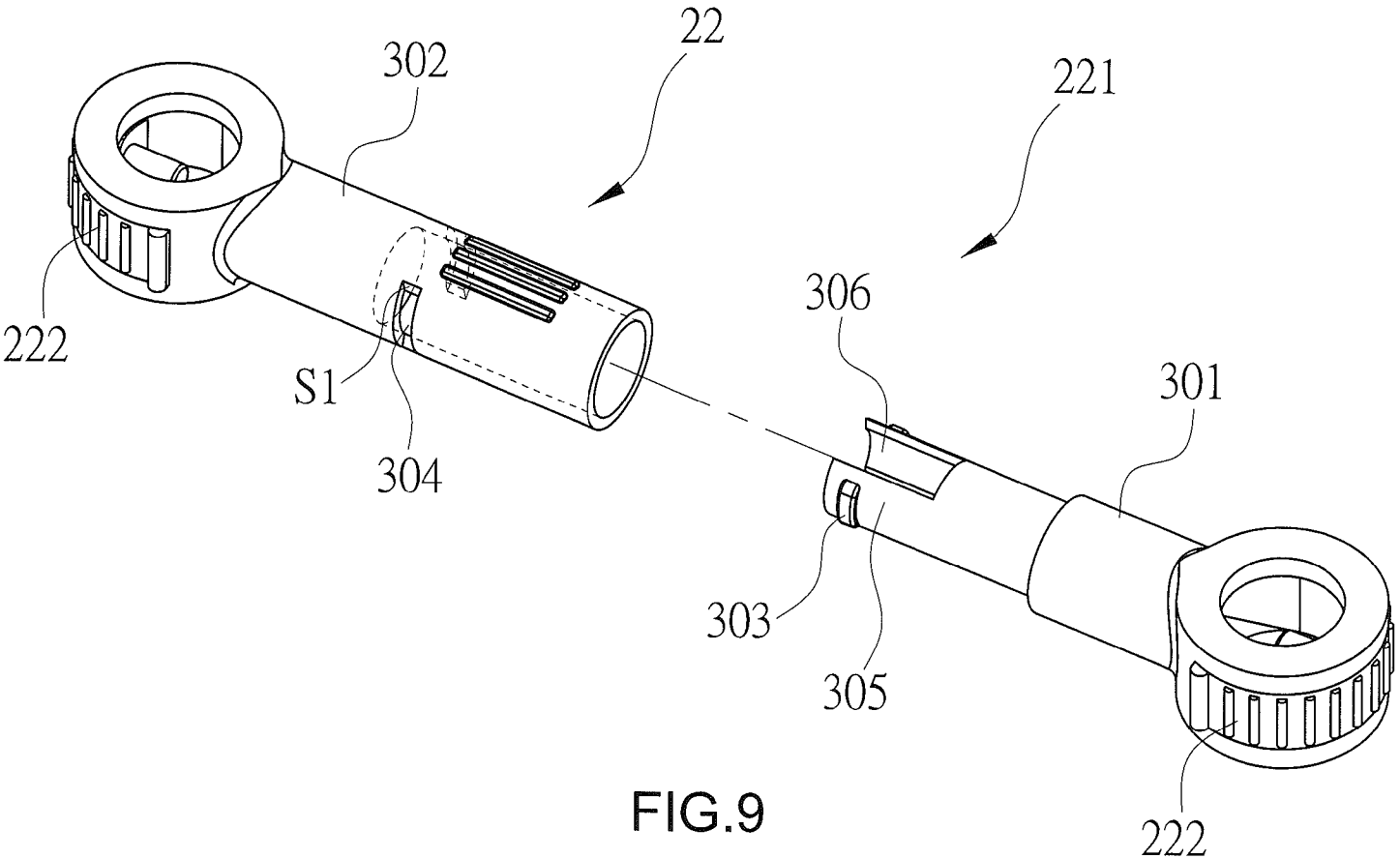
FIG. 9 shows an exploded view of a handgrip of another embodiment of the present invention.
Figure 10:
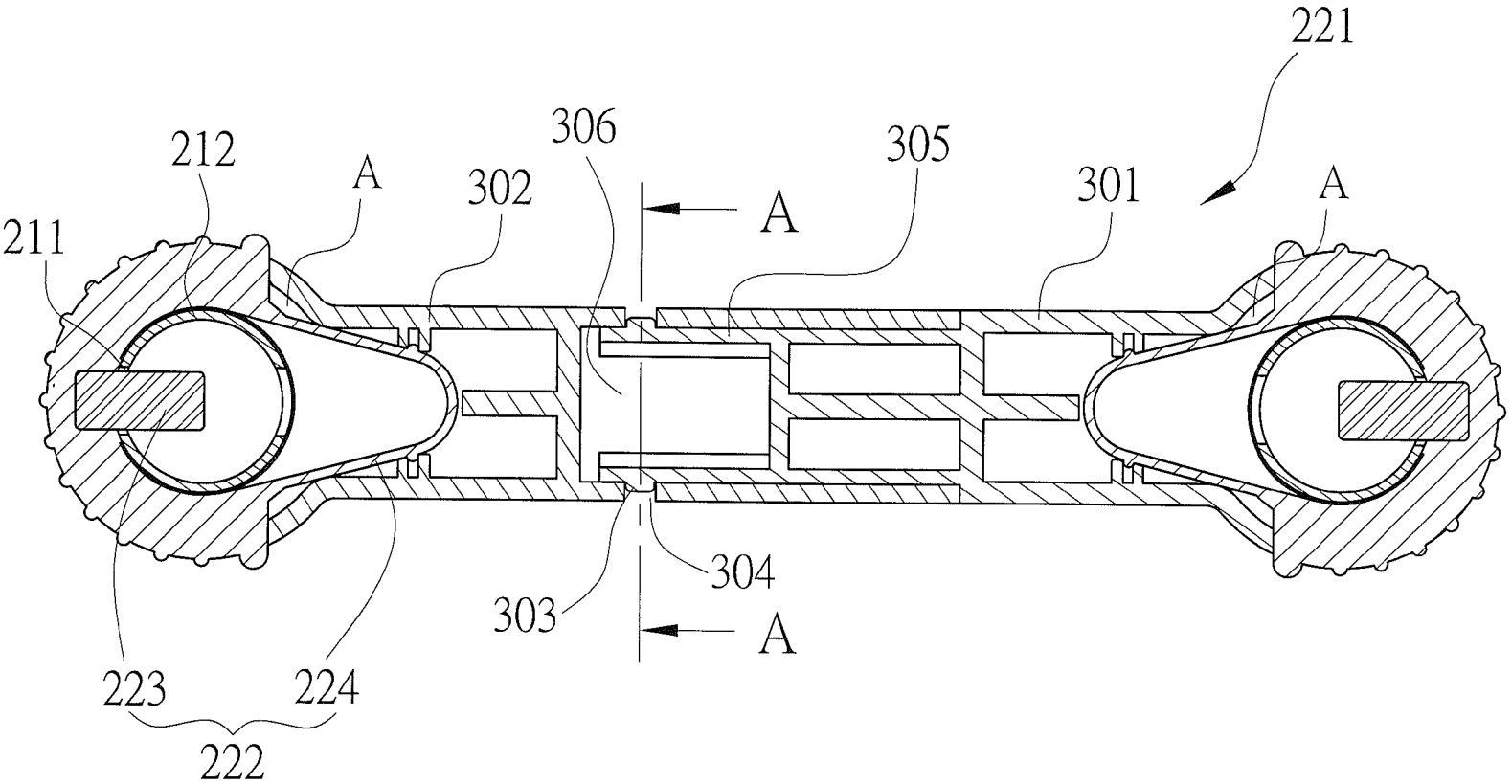
FIG. 10 shows a sectional view of the handgrip of FIG. 9.

FIGS. 9 and 10 show a handgrip 22 of another embodiment of the present invention, wherein the sleeve 23 is not included. In this embodiment, the main piece 221 includes two sub-pieces 301, 302 being assembled in a detachable manner. In assembling the handgrip 22, firstly, the two sub-pieces 301, 302 are in a separated state. Next, the sleeve 23 can be mounted around one of the two sub-pieces 301, 302, and then the two sub-pieces 301, 302 can be assembled together. With the structure of the main piece 221, the handgrip 22 can be assembled to the main frame 21 more quickly and conveniently.

Furthermore, one sub-piece 301 is provided with at least one protrusion 303 while the other sub-piece 302 defines a mounting hole 304 corresponding to the protrusion 303. The protrusion 303 can be engaged with the mounting hole 304 to interconnect the two sub-pieces 301, 302. In the embodiment, the sub-piece 301 can be inserted into the sub-piece 302 to allow the protrusion 303 to be engaged with the mounting hole 304. Also, with the design of the sub-pieces 301, 302, the protrusion 303 can be disengaged from the mounting hole 304, which will be fully described below.

Figure 11A:
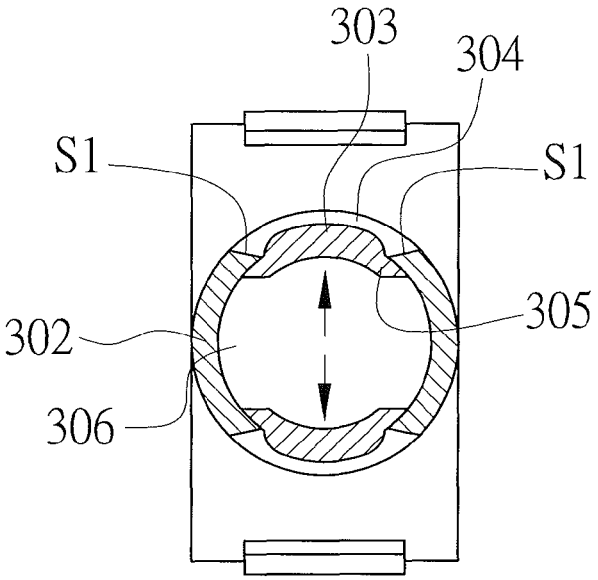
FIG. 11A shows a sectional view taken along line A-A in FIG. 10, wherein protrusions of a main piece are engaged with mounting holes of the main piece.

In the embodiment, the protrusion 303 can have a profile of varied height. For example, the protrusion 303 can have a maximal height at its middle, wherein the height diminishes gradually to its two ends. In other words, the height of the middle of the protrusion 303 is greater than the heights of the two ends of the protrusion 303, and this feature may facilitate the protrusion 303 to engage with the mounting hole 304. Furthermore, the mounting hole 304 can be defined between two opposite slant sides (S1), as shown in FIG. 11A. As such, the protrusion 303 can be easily engaged with or disengaged from the mounting hole 304 through the two opposite slant sides (S1). In other words, the two slant sides (S1) allow the protrusion 303 to be engaged with or disengaged from the mounting hole 304 more smoothly.

Figure 11B:
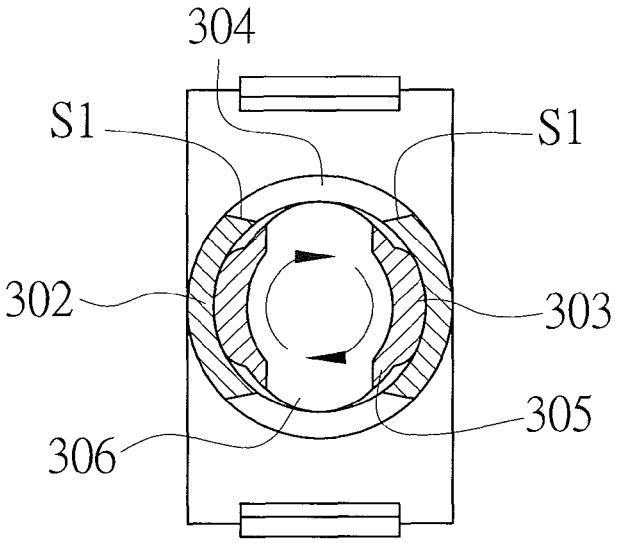
FIG. 11B shows a sectional view similar to FIG. 11A, wherein the protrusions of the main piece have been rotated to leave the mounting holes of the main piece.

Furthermore, the protrusion 303 can be provided on an elastic portion 305 of the sub-piece 301. The elasticity of the elastic portion 305 can be achieved by employing a material, a structure, or a combination thereof. For example, the elasticity of the elastic portion 305 can be achieved by employing two separate extensions with spaces 306 therebetween. Thus, in assembling the two sub-pieces 301, 302, the elastic portion 305 of the sub-piece 301 can deform inwardly to allow the protrusion 303 to be fitted into the mounting hole 304 of the sub-piece 302. Alternatively, the protrusion 303 can be individually made of an elastic material to be fitted into the mounting hole 304. As shown in FIGS. 11A and 11B, since the middle of the protrusion 303 has a greater height than the ends of the protrusion 303, the protrusion 303 can be fitted into the mounting hole 304 easily. After the mounting, the protrusion 303 is uneasy to slip off the mounting hole 304. When the protrusion 303 is required to be disengaged from the mounting hole 304, a user can rotate the sub-piece 301 relative to the sub-piece 302 to allow the protrusion 303 to pass the slant sides (S1) to achieve the user's need.

As a summary, in operating the crutch 2 of the present invention, no matter whether the positioning stud 223 of each fastener 222 is inserted into or clear of an associated positioning hole 211, due to the fastener 222 being included of the first portion 224 and the second portion 225 and formed into a completely closed member that encloses one post 212 of the main frame 21, the fastener 222 is unable to leave the post 212, and this feature can facilitate a user in adjusting the height of the handgrip 22. Furthermore, since the first portion 224 and the second portion 225 enclose the post 212, the first portion 224 can resist the forces of various directions, so that the first portion 224 is not easy to be damaged and thus the product durability can be increased. Furthermore, since the main piece 221 can be disassembled into two separate sub-pieces 301, 302, replacement of the sleeve 23 can be performed more easily.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A crutch, comprising:

a main frame including two spaced posts, each post defining a plurality of positioning holes, and a handgrip including a main piece and two fasteners, wherein the main piece defines two receiving spaces at its two opposite ends for receiving the two posts of the main frame, and each fastener has a positioning stud, a first portion, and a second portion, wherein the positioning stud is provided at the second portion and faces towards the first portion, the first portion and the second portion are formed into a completely closed member that encloses one of the two posts of the main frame and is operable to move between a first position and a second position; wherein when each fastener is moved to the first position, the positioning stud thereof is inserted into one of the positioning holes of one post, while the first portion thereof is engaged with one end of the main piece; when the fastener is moved to the second position, the positioning stud thereof is clear of the positioning hole, while the fastener is unable to leave the post.

2. The crutch according to claim 1, wherein the first portion of each fastener of the handgrip is provided with an engagement protrusion while the main piece of the handgrip defines an engagement recess corresponding to the engagement protrusion.

3. The crutch according to claim 1, wherein the first portion of each fastener of the handgrip defines an engagement recess while the main piece of the handgrip is provided at its one end with an engagement protrusion corresponding to the engagement recess.

4. The crutch according to claim 1, wherein the second portion of each fastener is formed as a curved structure conforming to an associated post of the main frame, the first portion of each fastener is formed as a curved structure opposite to the second portion of the fastener, the two curved structures are formed into a completely closed member that defines a confined space therebetween for receiving the associated post of the main frame, and the first portion of the fastener is configured with at least two different curvatures, the utmost of which is located halfway of the first portion, at a greatest distance from the second portion of the fastener.

5. The crutch according to claim 1, wherein the first portion is partially made of elastic material.

6. The crutch according to claim 1, wherein the second portion of each fastener functions as an operational grip.

7. The crutch according to claim 6, wherein the operational grip is provided with a rugged surface.

8. The crutch according to claim 1, wherein each fastener is movable along the extending direction of the positioning stud to the first position or the second position.

9. The crutch according to claim 1, wherein the main piece of the handgrip includes two sub-pieces being assembled in a detachable manner.

10. The crutch according to claim 9, wherein one of the sub-pieces of the main piece is provided with a protrusion while another one of the sub-pieces of the main piece defines a mounting hole corresponding to the protrusion.

11. The crutch according to claim 10, wherein the protrusion has a maximal height at its middle, the height diminishing gradually to its two ends; the mounting hole is defined between two opposite slant sides; and the protrusion is engaged with or disengaged from the mounting hole through the two opposite slant sides.

* * * * *